US007433627B2

(12) United States Patent
German et al.

(10) Patent No.: US 7,433,627 B2
(45) Date of Patent: Oct. 7, 2008

(54) ADDRESSABLE IRRADIATION OF IMAGES

(75) Inventors: Kristine A. German, Webster, NY (US); Robert M. Lofthus, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 527 days.

(21) Appl. No.: 11/168,152

(22) Filed: Jun. 28, 2005

(65) Prior Publication Data

US 2006/0290760 A1 Dec. 28, 2006

(51) Int. Cl.
*B41J 2/01* (2006.01)
*G03G 15/20* (2006.01)

(52) U.S. Cl. ..... 399/102; 347/102

(58) Field of Classification Search ..... 347/102, 347/238, 100, 19; 399/320, 336, 341; 427/493, 427/466; 359/732
See application file for complete search history.

(56) References Cited

U.S. PATENT DOCUMENTS 4,070,497 A * 1/1978 Wismer et al. ..... 427/493
4,579,446 A 4/1986 Fujino et al.
4,587,532 A 5/1986 Asano
4,791,447 A 12/1988 Jacobs
4,836,119 A 6/1989 Siraco et al.
4,928,148 A 5/1990 Higashi
4,978,969 A 12/1990 Chieng
5,004,222 A 4/1991 Dobashi
5,019,869 A 5/1991 Patton
5,053,828 A 10/1991 Ndebi et al.
5,080,340 A 1/1992 Hacknauer et al.
5,095,342 A 3/1992 Farrell et al.
5,159,395 A 10/1992 Farrell et al.
5,208,640 A 5/1993 Horie et al.
5,272,511 A 12/1993 Conrad et al.
5,296,904 A 3/1994 Jackson
5,326,093 A 7/1994 Sollitt
5,435,544 A 7/1995 Mandel
5,436,710 A * 7/1995 Uchiyama ..... 399/336
5,459,561 A 10/1995 Ingram (Continued)

FOREIGN PATENT DOCUMENTS

JP 2000085178 A * 3/2000

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Stephen D Meier
*Assistant Examiner*—Carlos A Martinez, Jr.
(74) *Attorney, Agent, or Firm*—Fay Sharpe LLP; Eugene O. Palazzo

(57) ABSTRACT

A marking system includes at least one image applying component for applying a marking material to a substrate in forming an image on the substrate. The marking material includes a radiation sensitive material. An addressable irradiation device receives the marked substrate from the image applying component. The irradiation device provides an array of addressable irradiation elements which irradiate the marked substrate. At least some of the irradiation elements are selectively actuable. The irradiation device emits radiation within a range of wavelengths to which the radiation sensitive material is sensitive.

23 Claims, 8 Drawing Sheets

U.S. PATENT DOCUMENTS 5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,710,968 A 1/1998 Clark et al.
5,777,350 A 7/1998 Nakamura et al.
5,778,377 A 7/1998 Marlin et al.
5,848,331 A 12/1998 Fromm
5,884,910 A 3/1999 Mandel
5,890,032 A 3/1999 Aslam et al.
5,995,721 A 11/1999 Rourke et al.
6,059,284 A 5/2000 Wolf et al.
6,088,565 A 7/2000 Jia et al.
6,125,248 A 9/2000 Moser
6,147,697 A * 11/2000 Deguchi et al. ..... 347/238
6,241,242 B1 6/2001 Munro
6,297,886 B1 10/2001 Cornell
6,310,115 B1 10/2001 Vanmaele et al.
6,341,773 B1 1/2002 Aprato et al.
6,384,918 B1 5/2002 Hubble, III et al.
6,393,245 B1 5/2002 Jia et al.
6,428,862 B1 8/2002 Noguchi
6,450,711 B1 9/2002 Conrow
6,457,823 B1 10/2002 Cleary et al.
6,466,750 B2 10/2002 McIntyre
6,476,376 B1 11/2002 Biegelsen et al.
6,476,923 B1 11/2002 Cornell
6,487,388 B2 11/2002 Theodoulou et al.
6,493,098 B1 12/2002 Cornell
6,512,914 B2 1/2003 Kabashima
6,535,712 B2 3/2003 Richards
6,536,889 B1 3/2003 Biegelsen et al.
6,537,910 B1 3/2003 Burke et al.
6,550,762 B2 4/2003 Stoll
6,554,276 B2 4/2003 Jackson et al.
6,559,878 B2 5/2003 McIlvaine et al.
6,562,413 B1 * 5/2003 Morgavi ..... 427/466
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,654,136 B2 11/2003 Shimada
6,661,993 B2 * 12/2003 Bartscher et al. ..... 399/341
6,671,486 B1 12/2003 Fletcher
6,687,479 B2 2/2004 Leute et al.
6,721,518 B2 4/2004 Oshida et al.
6,725,010 B1 4/2004 Parker
6,744,527 B1 6/2004 Dorsey et al.
6,745,000 B2 6/2004 Pirwitz
6,757,514 B2 6/2004 Berkes et al.
6,784,027 B2 8/2004 Streubel et al.
6,790,875 B2 9/2004 Noguchi et al.
6,819,906 B1 11/2004 Herrmann et al.
6,919,997 B2 * 7/2005 Forrer et al. ..... 359/732
7,197,271 B2 3/2007 Nakamura et al.
2002/0078012 A1 6/2002 Ryan et al.
2002/0103559 A1 8/2002 Gartstein
2003/0077095 A1 4/2003 Conrow
2003/0081096 A1 * 5/2003 Young ..... 347/102
2003/0228181 A1 12/2003 Fletcher
2003/0231234 A1 * 12/2003 Ushirogouchi et al. ..... 347/100
2004/0085423 A1 * 5/2004 Bronstein et al. ..... 347/102
2004/0085561 A1 5/2004 Fromherz
2004/0085562 A1 5/2004 Fromherz
2004/0088207 A1 5/2004 Fromherz
2004/0114976 A1 6/2004 Weber et al.
2004/0119772 A1 * 6/2004 Hoshino et al. ..... 347/19
2004/0150156 A1 8/2004 Fromherz et al.
2004/0150158 A1 8/2004 Biegelsen et al.
2004/0153983 A1 8/2004 McMillan
2004/0155395 A1 8/2004 Milillo et al.
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.

FOREIGN PATENT DOCUMENTS

WO WO 97/48138 12/1997

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel, et al.
U.S. Appl. No. 10/785,211, filed Feb. 24, 2004, Lofthus, et al.
U.S. Appl. No. 10/881,619, filed Jun. 30, 2004, Bobrow.
U.S. Appl. No. 10/917,676, filed Aug. 13, 2004, Lofthus, et al.
U.S. Appl. No. 10/917,768, filed Aug. 13, 2004, Lofthus, et al.
U.S. Appl. No. 10/924,106, filed Aug. 23, 2004, Lofthus, et al.
U.S. Appl. No. 10/924,113, filed Aug. 23, 2004, deJong, et al.
U.S. Appl. No. 10/924,458, filed Aug. 23, 2004, Lofthus, et al.
U.S. Appl. No. 10/924,459, filed Aug. 23, 2004, Mandel, et al.
U.S. Appl. No. 10/933,556, filed Sep. 3, 2004, Spencer, et al.
U.S. Appl. No. 10/953,953, filed Sep. 29, 2004, Radulski, et al.
U.S. Appl. No. 10/999,326, filed Nov. 30, 2004, Grace, et al.
U.S. Appl. No. 10/999,450, filed Nov. 30, 2004, Lofthus, et al.
U.S. Appl. No. 11/000,158, filed Nov. 30, 2004, Roof.
U.S. Appl. No. 11/000,168, filed Nov. 30, 2004, Biegelsen, et al.
U.S. Appl. No. 11/000,258, filed Nov. 30, 2004, Roof.
U.S. Appl. No. 11/001,890, filed Dec. 2, 2004, Lofthus, et al.
U.S. Appl. No. 11/002,528, filed Dec. 2, 2004, Lofthus, et al.
U.S. Appl. No. 11/051,817, filed Feb. 4, 2005, Moore, et al.
U.S. Appl. No. 11/070,681, filed Mar. 2, 2005, Viturro, et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark, et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore, et al.
U.S. Appl. No. 11/094,998, filed Mar. 31, 2005, Moore, et al.
U.S. Appl. No. 11/094,864, filed Mar. 31, 2005, de Jong, et al.
U.S. Appl. No. 11/095,872, filed Mar. 31, 2005, Julien, et al.
U.S. Appl. No. 11/102,355, filed Apr. 8, 2005, Fromherz, et al.
U.S. Appl. No. 11/084,280, filed Mar. 18, 2005, Mizes.
U.S. Appl. No. 11/109,566, filed Apr. 19, 2005, Mandel, et al.
U.S. Appl. No. 11/109,558, filed Apr. 19, 2005, Furst, et al.
U.S. Appl. No. 11/109,996, filed Apr. 20, 2005, Mongeon, et al.
U.S. Appl. No. 11/093,229, filed Mar. 29, 2005, Julien.
U.S. Appl. No. 11/102,899, filed Apr. 8, 2005, Crawford, et al.
U.S. Appl. No. 11/102,910, filed Apr. 8, 2005, Crawford, et al.
U.S. Appl. No. 11/115,766, filed Apr. 27, 2005, Grace.
U.S. Appl. No. 11/102,332, filed Apr. 8, 2005, Hindi, et al.
U.S. Appl. No. 11/136,959, filed May 25, 2005, German, et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus, et al.
U.S. Appl. No. 11/137,251, filed May 25, 2005, Lofthus, et al.
U.S. Appl. No. 11/137,273, filed May 25, 2005, Anderson, et al.
U.S. Appl. No. 60/631,651, filed Nov. 30, 2004, Anderson, et al.
U.S. Appl. No. 60/631,918, filed Nov. 30, 2004, Anderson, et al.
U.S. Appl. No. 60/631,921, filed Nov. 30, 2004, Anderson, et al.

* cited by examiner

ADDRESSABLE IRRADIATION OF IMAGES

BACKGROUND

The present embodiment relates to the irradiation of marked media. It finds particular application in conjunction with an irradiation system in which ultraviolet (UV) radiation is selectively applied to an imaged region of print media to fuse, cure, or dry the image. However, it is to be appreciated that the present embodiment is also amenable to other like applications.

Printing methods, such as xerographic and ink-jet printing methods, use fusing or curing as a way to provide image permanence. Ink-jet printing methods often use a water-based marking material or ink which is applied to a substrate, such as paper. The ink remains wet until air dried or heat dried. If printed pages are stacked without sufficient drying time, ink may smear or transfer to the adjacent sheet. Drying time is therefore an obstacle to high speed printing. In applications where double-side printing is used, or where printing is performed on non-absorbent substrates, the slow dry time can be an even larger obstacle to high print speeds.

UV curable inks have been developed to address problems of drying and permanence of images in ink-jet printing systems. The inks are cured with a UV flood lamp. UV curable inks have also been developed for printing systems that jet melted ink that is solid at ambient temperatures. For these inks, UV curing hardens the ink compared to its un-irradiated state, thereby improving the prints resistance to scratching, smearing, and transferring. This is particularly important for prints that may be exposed to higher pressures and/or temperatures than usual. Furthermore, the chemical crosslinking that can be achieved by UV curing can create desirable material properties for the printed ink that are not achieved with ordinary heat based curing approaches.

In typical xerographic marking devices, a dry marking material, such as toner particles adhering triboelectrically to carrier granules, is used to create an image on a photoconductive surface which is then transferred to a substrate. The toner image is generally fused to the substrate by applying heat to the toner with a heated roller and application of pressure to melt or otherwise fuse the dry marking material. The fusing process serves two functions, namely to attach the image permanently to the sheet and to achieve a desired level of gloss.

In multi-color printing, successive latent images corresponding to different colors are recorded on the photoconductive surface and developed with toner of a corresponding color. The single color toner images are successively transferred to the copy paper to create a multi-layered toner image on the paper. The multi-layered toner image is permanently affixed to the copy paper in the fusing process.

Fusers, because of the high temperatures at which they operate and frequent heating and cooling cycles that they undergo, tend to be prone to failure or suffer reliability issues. The reliability issues are of particular concern in printing systems which employ several small marking devices. These systems enable high overall outputs to be achieved by printing portions of the same document on multiple printers in which an electronic print job may be split up for distributed higher productivity printing by different marking devices, such as separate printing of the color and monochrome pages. However, since each marking device in the printing system has its own dedicated fuser, the reliability issues are compounded.

Alternative fusers have been developed which employ light for fusing images. For example, high energy laser beams have been used to fuse toner particles.

These methods for fusing and curing images all involve exposing the entire sheet to the energy source, which is both energy consuming and generates excess energy to be dissipated by the fusing system and may also cause sheet shrinkage and or curl.

REFERENCES

U.S. Pat. No. 5,459,561 to Ingram, entitled METHOD AND APPARATUS FOR FUSING TONER INTO A PRINTED MEDIUM, which is incorporated herein by reference in its entirety, discloses fusing a toner image with a high-energy laser beam using an optical scanner.

U.S. Pat. No. 5,436,710 to Uchiyama, entitled FIXING DEVICE WITH CONDENSED LED LIGHT, which is incorporated herein by reference in its entirety, discloses a fixing device which includes an LED array and a cylindrical lens. The lens condenses the light from the LED array onto the toner image and fuses it to the sheet.

U.S. Pat. No. 6,536,889 to Biegelsen, et al., entitled SYSTEMS AND METHODS FOR EJECTING OR DEPOSITING SUBSTANCES CONTAINING MULTIPLE PHOTOINITIATORS, which is incorporated herein by reference in its entirety, discloses inks for use in inkjet printing which comprise UV-sensitive photoinitiators which are responsive to different UV wavelengths.

BRIEF DESCRIPTION

Aspects of the present disclosure in embodiments thereof include a marking system and a method of marking. In one aspect, the marking system includes at least one image applying component for applying a marking material to a substrate in forming an image on the substrate. The marking material includes a radiation sensitive material. An addressable irradiation device receives the marked substrate from the image applying component. The irradiation device provides an array of addressable irradiation elements which irradiate the marked substrate. At least some of the irradiation elements are selectively actuable. The irradiation device emits radiation within a range of wavelengths to which the radiation sensitive material is sensitive.

In another aspect, the marking system includes at least one marking device for applying a marking material to a substrate in forming an image on the substrate. The marking material includes a radiation sensitive material. An irradiation device includes an array of addressable irradiation elements, the irradiation device receiving the substrate and irradiating an area of the substrate which is substantially no larger than that covered by the image by selective activation of the array of addressable irradiation elements as the substrate moves relative to the array. In another aspect, the marking method includes applying a marking material to a substrate to form an image on the substrate, the marking material comprising a radiation sensitive material. The marked substrate is irradiated with an array of addressable irradiation elements, at least a plurality of the irradiation elements emitting radiation in a range of wavelengths within which the radiation sensitive material reacts. The plurality of irradiation elements are selectively actuated.

DETAILED DESCRIPTION

Figure 1:
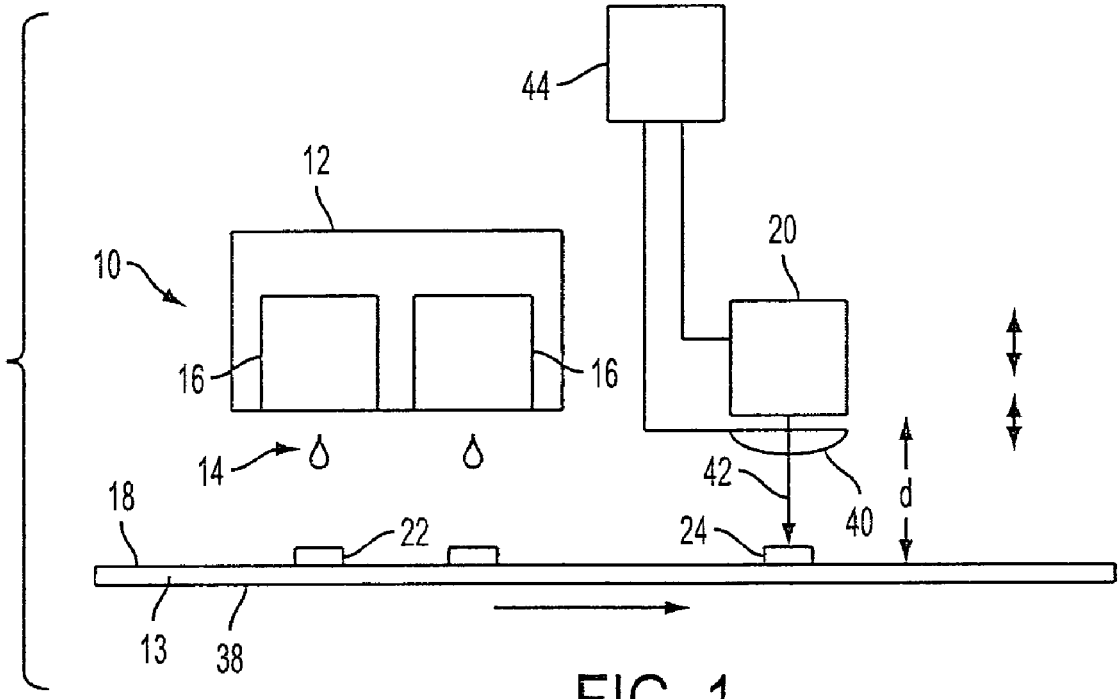
FIG. 1 is a schematic side view of a marking system according to a first aspect of the exemplary embodiment.

Aspects of the exemplary embodiment relate to a marking system comprising at least one marking device which applies a marking material to a substrate, such as print media, the marking material comprising a radiation-sensitive material which reacts upon exposure to radiation within a range of wavelengths and an irradiation device which irradiates the substrate with radiation within the range of wavelengths, the irradiation device including an array of selectively addressable irradiation elements.

The marking system may be a printing system, such as a xerographic system in which dry toner is applied to a substrate, or an ink-jet, gravure, or offset system, in which a liquid marking material is applied to the substrate. In both liquid ink systems and solid toner systems, the marking material forms an image on the substrate. The marking system may include one or a plurality of marking devices, such as one, two, three, four, six, eight, or more marking devices. In various aspects, each marking device may be associated with its own dedicated irradiation device. In other aspects, a plurality of marking devices is associated with a common irradiation device. In various aspects, the marking device includes a primary fixing (e.g., fusing) device which serves to at least tack the marked media to the substrate, the irradiation device applying a further fixing treatment to the marked substrates. In one specific aspect, the irradiation device is a common fusing device which augments the fusing performance of primary fusing devices resident in a plurality of marking devices.

The substrate may be a usually flimsy physical sheet of paper, plastic, or other suitable physical print media for images, whether precut or web fed.

The array of addressable irradiation elements may include a single irradiation source, such as a laser, e.g., a raster output scanner (ROS) which scans across the sheet. A scanning laser beam of this type is described, for example, in U.S. Pat. No. 5,459,561 to Ingram, which is incorporated herein in its entirety by reference. Alternatively, the array may include a plurality of irradiation sources, such as a vertical-cavity surface-emitting laser (VCSEL) array, or an array of light emitting diodes or laser diodes, both of which will be referred to herein as LEDs. In one embodiment, an array is formed by a string of addressable elements in the shape of a spiral wound around a cylindrical core which is rotated relative to the substrate. Similarly, an array of addressable elements may be achieved by a single irradiation source which follows a spiral path, the path being rotated relative to the substrate.

Each of the addressable irradiation elements may be independently controllable. For example, an addressing system selectively addresses the elements of the array to cause the elements to change state. In this way, the array is capable of selectively irradiating portions of a marked substrate as the substrate moves relative to the array. In various aspects, the addressable irradiation elements each have at least two intensity states, such as on and off. The radiation from two or more addressable irradiation elements may be combined to provide different levels of irradiation to a single point on a substrate. In other aspects, at least some of the addressable fusing elements have a range of states, such that the radiation energy is variable over a range of intensities between maximum and minimum values. In various aspects, the elements can change state in a time which is substantially less than the time required for a sheet to pass the array, thereby allowing multiple portions of an image to be selectively irradiated.

In one embodiment, the addressable irradiation elements are actuated to expose marked areas of a substrate to the radiation while unmarked areas are substantially unexposed. In one aspect, where several marking materials are applied to a substrate, such as marking materials comprising cyan, magenta, yellow, and black colorants, respectively, the irradiated portion of the substrate includes only the immediate neighborhood of the applied marking materials, which may be minimally larger than the union of those portions of the substrate which have been marked by the marking materials. As a result, portions which are outside the immediate neighborhood of the applied marking material(s) receive little or no irradiation. This reduces the amount of radiation applied to a substrate which has incomplete coverage of marking media. Further, it will be appreciated that the where different images are applied, different portions of the respective substrates can be irradiated. Additionally, by varying the intensity of the radiation marked portions which benefit from higher irradiation, such as those with greater ink drop density or toner pile heights can be exposed to higher radiation intensity than those for which lesser intensities are satisfactory. The intensity of the radiation can also be varied to accommodate different substrate weights, which may benefit from higher radiation intensities. The UV radiance typically required to cure opaque inks is in the range of 1-20 watts/cm$^2$.

In various aspects, the marking system includes a control system in communication with the addressing system which identifies portions of a digital image, or corresponding marked substrate from which the image is derived, that are marked or are to be marked, which enables the addressing system to determine which of the plurality of addressable elements to actuate to effect irradiation of the image. To register the area of cure to the area which has been marked, various techniques exist. For example, Video Path Electronic Registration (ViPER), which was developed for registration of color separations may be adapted for this purpose. Electronic registration of images is described, for example, in US Published Application No. 2004/0212853, published Oct. 28, 2004, for ELECTRONIC IMAGE REGISTRATION FOR A SCANNER by Kelly, et al., the disclosure of which is incorporated herein by reference.

The marking material may comprise dry toner particles, a liquid ink, or a liquefiable ink which is melted before applying to the substrate (often referred to as a solid ink because the ink is solid at room temperature. The marking material, whether it comprises toner particles, typically associated with a carrier material, or a liquid or liquefiable ink, includes at least one radiation sensitive material that reacts upon exposure to a range of wavelengths of electromagnetic radiation. Subsequently, the marking material is irradiated with an amount of electromagnetic radiation in the range of wavelengths effective to cause the radiation sensitive material(s) to react. In the case of a xerographic system this effects what is typically referred to as fusing. In an ink-jet system, the result may be expressed in terms of curing. In both cases, the irradiation may influence the permanence of the marked substrate, such that the marking material is more securely attached to the substrate. Alternatively or additionally, the viscosity of the marking material can be altered to shorten the drying time of the marking material or to make the marking material sufficiently cured for immediate stacking or handling prior to achieving its final state. Material properties such as color, hardness, or electrical conductivity of the marking material can also be altered by the irradiation.

The radiation sensitive material may comprise a photosensitive resin that polymerizes upon exposure to ranges of wavelengths of radiation specific to the radiation sensitive material. Where a plurality of radiation sensitive materials is present in the marking material, these may each respond to a different, distinct wavelength range. In the case of an ink, the marking material may comprise a pigment dispersed in an aqueous or organic solvent such as water, toluene, methylethylketone, or the like. The radiation sensitive material may comprise a polymerizable resin comprising a monomer or monomers which polymerize in the presence of the radiation typically together with a suitable photoinitiator, as is known in the art. Exemplary resins include urethanes and acrylates, such as aliphatic urethane-based oligomers, ester-based acrylates, and the like. Or, the solvent itself may be a polymerizable material. In the case of a dry toner composition, the radiation sensitive material may be incorporated into or comprise the resin material for the toner particles. Suitable UV curable inks are described, for example, in U.S. Pat. No. 4,978,969 to Chieng, U.S. Pat. No. 6,428,862 Noguchi, U.S. Pat. No. 6,790,875 to Noguchi, et al., and U.S. Pat. No. 6,310,115 to Vanmaele, et al., the disclosures of which are incorporated herein in their entireties by reference. UV curable gelators for use in liquid or solid inks are described, for example, in application Ser. No. 11/034,866, filed Jan. 14, 2005, for "RADIATION CURABLE INKS CONTAINING CURABLE GELATOR ADDITIVES," by Breton. The gelators may include amphiphilic structures, such as N-acyl-1,n-amino acid derivatives, trans-1,2-bis(ureido)cyclohexane derivatives, as well as ortho-bis(ureido)benzene derivatives.

The marking material may be deposited on the substrate as a single material or as separate materials. For example, toners or inks each comprising a different pigment, such as cyan, magenta, yellow, or black pigment, may be separately laid down on the substrate.

The marking material may include a first photoinitiator that responds to exposure to a first range of wavelengths of electromagnetic radiation and a second initiator that responds to exposure to a second range of wavelengths of electromagnetic radiation that is distinct from the first range of wavelengths. Subsequently, the marking material is irradiated with an amount of electromagnetic radiation in the first range of wavelengths effective to cause the first photoinitiator to react, and then irradiating the at least one marking material with an amount of electromagnetic radiation in the second range of wavelengths effective to cause the second photoinitiator to react, as described, for example, in above-mentioned U.S. Pat. No. 6,536,889.

The addressable elements may emit electromagnetic radiation in a range of wavelengths, including a wavelength or range of wavelengths to which the radiation sensitive material reacts. In one aspect, the addressable irradiation elements emit electromagnetic radiation in the ultraviolet (UV) range of the spectrum and the radiation sensitive material(s) reacts to electromagnetic radiation in the ultraviolet (UV) range of the spectrum. The UV range is typically considered to be the range between soft X-rays and visible violet light, ranging from about 10 nanometers (nm) to about 375 or 400 nm. The range includes wavelengths classified as UV-A (315-400 nm), UV-B (280-315 nm), and UV-C (100-280 nm). An exemplary wavelength range is from about 250 to about 300 nm. In one specific embodiment, at least about 80% of the radiation emitted by the addressable elements falls within this range. Suitable elements include ultraviolet light emitting semiconductor devices such as an $Al_xGa_{1-x}N$ LEDs, wherein changing the relative proportions of Al and Ga can affect the wavelength of emitted light. Such devices are described, for example, in U.S. Pat. No. 5,777,350 and WO 97/48138 to Philips Electronics, the disclosures of which are incorporated herein by reference in their entireties.

The array may include groups of addressable elements, each group irradiating in a different wavelength range. For example, the array may include a plurality of elements which irradiate the substrate with radiation in a first wavelength range and elements which irradiate the substrate in a second wavelength range. For example, a first set of elements irradiates in a wavelength range at which a first radiation sensitive material reacts, such as a photoinitiator in a cyan colored marking material, a second set of elements irradiates in a wavelength range at which a second photoinitiator reacts, such as a photoinitiator in a magenta colored marking material, and so forth for yellow and black marking materials. Each of the elements may be actuated so as to irradiate substantially only those portions of the image comprising the corresponding marking material.

In an alternative embodiment, an addressable irradiation device includes optics and radiation source resembling a traditional ROS. In this embodiment, a switchable UV source with a faceted rotating UV mirror is directed at the marked sheet. The source can write at different irradiation levels and can have a spot size somewhat larger than the pixel size of the marking device.

In various aspects of the exemplary embodiment, a marking method includes irradiating the marking material with an amount of radiation in a range of wavelengths which causes the radiation sensitive material to react. The method includes marking a substrate with a marking material which includes a radiation sensitive material to form an image on the substrate and irradiating the marked substrate with an array of addressable irradiation elements, the array being operable to irradiate an area of the substrate which is only minimally larger than the image. The marking method may serve to achieve different humanly visible process colors, for example, in the cyan, magenta, yellow and black (CMYK) system or the red, green, blue, and black (RGBK) system, which is useful in printing on transparent substrates.

In various exemplary embodiments, the systems and methods described herein can also include transferring the marking material from the substrate to a second substrate after irradiating the marking material. In various exemplary embodiments, transferring the substance from the first substrate to the second substrate includes transferring the substance from an intermediate transfer belt or drum to a sheet of paper.

By way of example, FIG. 1 shows a marking system 10 of the type which uses liquid marking media. The marking system 10 includes a marking device 12 for marking a substrate 13 with one or more marking materials in the form of inks 14. At least one of the inks 14 includes a radiation curable material, as described above. The marking device 10 includes an image applying component 16 which serves to apply the ink to an upper surface 18 of the substrate 13. As will be appreciated, there may be several image generation devices 16 in a single marking device 12. An irradiation system 20, which may be incorporated in the marking device 12 or positioned downstream of the marking device to receive marked substrate therefrom, irradiates an image 22 formed from the deposited inks or inks on the substrate to form an irradiated image 24. The image applying component 16 can be an ink-jetting system, a transfer roller, or any other means of depositing the ink onto the substrate. The image applying component 16 is usable to deposit at least one marking material 14 on the substrate. The at least one marking material 14 can include a radiation sensitive material which may include at least a first photoinitiator that reacts upon exposure to a first range of UV wavelengths. The irradiation system 18 can be usable to irradiate the marking material 14 with UV-radiation that is within the ranges of wavelengths specific to the first photoinitiator.

Figure 2:
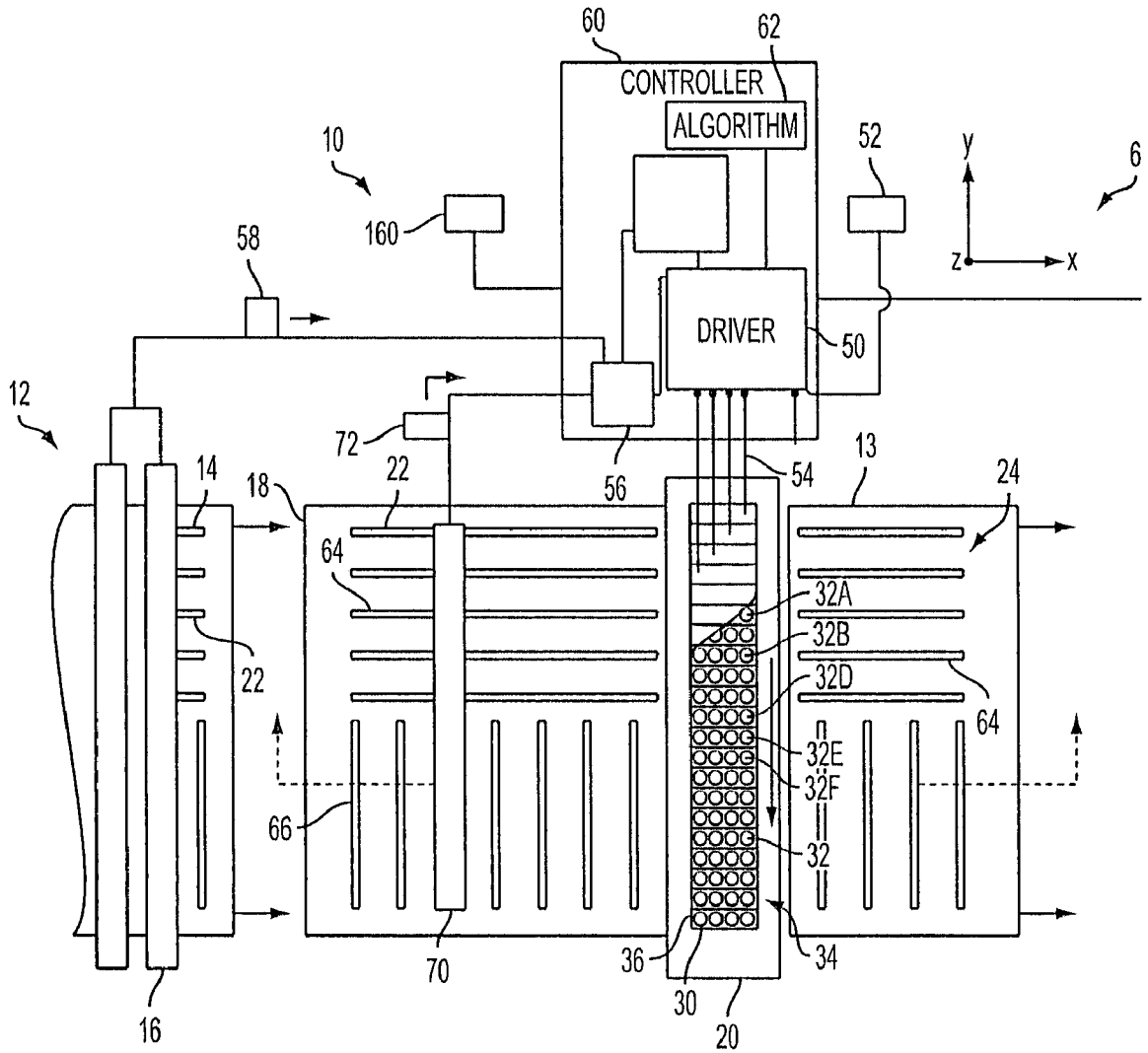
FIG. 2 is an enlarged top plan view of the marking system of FIG. 1 including a marking device and an irradiation device which includes an array of addressable irradiation elements.

With reference also to FIG. 2, a coordinate system with X-Y-Z axes is shown for ease of reference. In general, the X axis corresponds to the machine direction or direction of travel and the Y-axis to the cross machine direction, while the Z direction extends above and below the substrate 13. As shown in FIG. 2, the irradiation system 20 includes an N×M array 30 of addressable irradiation elements 32, of the type described above, wherein N the number of elements in the machine (X) direction and M is the number of elements in the cross machine (Y) direction and N≧1 and M≧1. For example, N and M individually can be 1, 2, 3, 5, 10, 20, or more, or the like, and at least one of N and M is >1. The exemplary array 30 is a 4×21 linear array, although in other embodiments, N can be 1. The illustrated irradiation elements are arranged in rows 34 in the machine direction and columns 36 in the cross machine direction, although in practice, there may be more rows than illustrated to provide a greater resolution. Array 30 has its length in the Y-direction and is arranged so that addressable irradiation elements 32 are in radiative communication with substrate upper surface 18 when substrate 13 is passing thereby. In general, the array is slightly spaced from the substrate surface 18 by a distance d in the z direction (FIG. 1). Alternatively, where the substrate is transmissive to the radiation, the array 30 may be located adjacent an opposed side of the substrate.

In an alternative embodiment, adjacent columns of addressable elements 32 are shifted relative to one another, e.g., by half the width of an element. This arrangement allows for a higher resolution in irradiated area to be obtained by overlapping the irradiated areas of adjacent shifted elements and providing an amount of power to each element such that the overlapped irradiated areas have sufficient irradiation to process marking material on the substrate (e.g., fuse of cure the marking material).

The exemplary array 30 is an LED array (e.g., an LED bar), a vertical-cavity surface-emitting laser (VCSEL) array, a liquid crystal pixel illuminated by a line illuminator or an edge-emitting laser diode array, e.g., such as that associated with a raster output scanner (ROS) configuration. The array 30 includes a relatively coarse distribution of addressable irradiation elements 32 as compared to the resolution of the image forming component 16, which is typically expressed in terms of pixels or dots per inch (dpi). Thus, exemplary array 30 includes on the order of about 1 to 20 addressable irradiation elements 32 per centimeter, such as about 2-10.

As illustrated in FIG. 1, a focusing lens 40 is optionally arranged adjacent array 30 to focus radiation 42 at a focal plane coincident with the image 22, which may include a plurality of lenslets, such as one for each irradiation element 32, as shown for example, in copending application Ser. No. 11/000,168. Alternatively or additionally, the focusing lens 40 may be translatable relative to the array to adjust focusing, such as in the X or Z direction. For example, the array 30 and focusing lens 40 may be operably coupled to a drive system 44 for movement of the array 30 and/or lens 40 (FIG. 1). The drive system may include a driver for one or both of the array and lens.

In one embodiment, the drive system includes a driver for Y direction translation of an array which can be less than a full width of the image and thereby provide selectively addressable elements across the full width of the image.

With reference again to FIG. 2, array 30 is operably (e.g., electrically) coupled to a programmable element driver (hereinafter "driver") 50, which in turn is operably (e.g., electrically) coupled to a power source 52. In the illustrated embodiment, each individual element 32 is individually connected to the driver 50 by a separate link 54, which may be a wired or wireless link, for individual actuation. Driver 50 may also operably (e.g., electrically) coupled to an electronic image storage device 56 (e.g., a buffer), which is operatively (e.g., electrically) coupled to marking device 12. Electronic image storage device 56 is adapted to store electronic (digital) images, such as an electronic image of marked image 22 created by marking device 12 and embodied in an electronic-image signal 58 (e.g., an electrical signal) provided to the storage device to allow registration of the irradiated area with the image.

In the exemplary embodiment, driver 50 and electronic image storage device 56 are part of a single controller 60 that also includes a programmable processor 62. Controller 60 is coupled to marking device 12 and to array 30 and lens drive system 44, and may be adapted to coordinate the operation of these and other elements in the marking system, as described below. In one embodiment, the coordinated operation of the controller 60 is achieved through a set of operating instructions (e.g., software) programmed into programmable processor 62.

In the operation of marking system 10, an electronic image of marked image 22 is captured upstream of irradiation device 20 via known techniques associated with the operation of marking device 12 in creating the marked image. The captured electronic image is embodied in electronic-image signal 58, which is then provided to electronic image storage device 56, where the electronic image is stored. Information regarding the (X, Y, θ) registration of the marked image 22 relative to substrate 13 in the upstream marking process that creates marked image 22 is recorded or is otherwise included in the electronic-image signal 58. For example, the electronic image is stored in rasterized format such as is created using a raster output scanner (ROS). Alternatively, the electronic image is stored as a bitmap. The electronic image is then provided to controller 60 and driver 50.

Substrate 13 proceeds from marking device 12 to irradiation device 20. As substrate 13 proceeds under the addressable elements 32, or shortly prior to the image reaching the elements 32, the addressable elements 32 in array 30 are selectively activated by driver 50 based on the information in the electronic image so that substantially only those portions of substrate surface 18 that include marking material 14 are irradiated.

In the selective activation of irradiation elements 32, as described above, it should be noted that the amount of radiation (UV radiation in the illustrated embodiment) provided by each addressable element 32 need not be the same for all elements 32 and that some of the elements may irradiate the portion of image 22 passing in radiative contact therewith at greater or lesser intensities than other elements. In other embodiments, selective actuation of two or more elements 32 in a single row 34 can provide a range of intensities of radiation to a pixel which is irradiated by the two or more elements 32. In some circumstances, it may be advantageous for each element 32 to provide a fixed amount of radiation. Such fixed irradiation may be suited, for example, to when untreated image 22 is relatively uniform in nature.

By way of example, image 22 shown on substrate surface 18 in FIG. 2 consists of thin horizontal lines 64 (extending in the X-direction) and thin vertical lines (extending in the Y-direction). As substrate 13 passes array 30, one or more addressable elements 32A, 32B, etc of array 30 that line up with (i.e., have the same general Y-coordinate as) a horizontal line 64 are activated, while those elements not lined up with a vertical line remain inactive. Similarly, addressable elements 32D, 32E, 32F, etc. of array 30 under which at least a portion of the vertical lines 66 will pass are activated each time a horizontal line passes beneath the array, and otherwise remain inactive while the space between lines passes beneath this portion of the array. In this manner, substantially only the marked image 22 is irradiated as the substrate passes the array 30. It will be appreciated that where lines 66 are too closely spaced for the addressable elements 32D, 32E, 32F, etc. to be activated and deactivated between each line, these elements may remain active for several lines. Which addressable elements are activated in the irradiation process is governed by the marked image 22 formed upstream. This allows for pattern-dependent image irradiation, rather than blanket irradiation of the substrate. In one aspect, only an area of substrate surface 18 that is minimally larger than that defined by the area of the marked image 22 is irradiated.

In one embodiment, the registration of the image as it reaches the array 18 is assumed to be the same as that during the marking process. This assumes that reasonable tolerances can be achieved. Calibration prints may be used as a measure of the registration tolerance. In another embodiment, the toner image is sensed directly prior to the substrate reaching the array 30. In another embodiment, a local autocorrelation of image 22 (or information relating thereto) with printing data is used to determine image properties such as the (X, Y, θ) registration and warpage.

In a more robust embodiment that can measure the dynamic and static registration, the (X, Y, θ) registration of image 22 on substrate 13 as it reaches the array 30 is measured and compared to the registration of image 22 as formed on substrate surface 18 during the upstream marking process. This is accomplished, for example, by capturing a second electronic image of the image via an image sensor 70, such as a digital camera, arranged upstream of array 30 and optically coupled to substrate 13 as it passes under the image sensor. Image sensor 70 is operably (e.g., electrically) coupled to driver 50, for example, through electronic image storage device 56, as shown. The second electronic image is embodied in a second electronic-image signal 72 provided from image sensor 70 to storage device 56. The relative (X, Y, θ) registrations of the first and second electronic images are then compared (e.g., with the assistance of processor 62) and any offset or warpage is accounted for in the selective activation of addressable irradiation elements 32.

In various aspects, image 22 includes cyan, yellow, magenta, and black images, and addressable elements 32 are activated so that an area on substrate surface 18 that is at most only minimally larger than that defined by the union of these images is irradiated.

The radiation from the array 30 causes the radiation sensitive material(s) in the marking material 14 to react by irradiating the marking material 14 with radiation having a wavelength within the range of wavelengths to which the radiation sensitive material(s) react, with an amount of radiation effective to achieve a desired property in the at least one marking material. Where two or more photoinitiators are employed different ones of the elements 32 may emit radiation in different wavelength ranges which match those of the two or more photoinitiators.

The marking system 10 may also include other components, such as a paper feeder (not shown) upstream of the marking device 12 and at least one output destination (not shown), such as a stacker, downstream of the fuser.

In various aspects of the exemplary embodiment, addressable fusing or irradiation is performed on both sides of the substrate being processed. The irradiation device may be configured for two sided irradiation of the substrate or separate irradiation devices may irradiate a respective side, as disclosed, for example in above-mentioned copending application Ser. No. 11/000,168.

Figure 3:
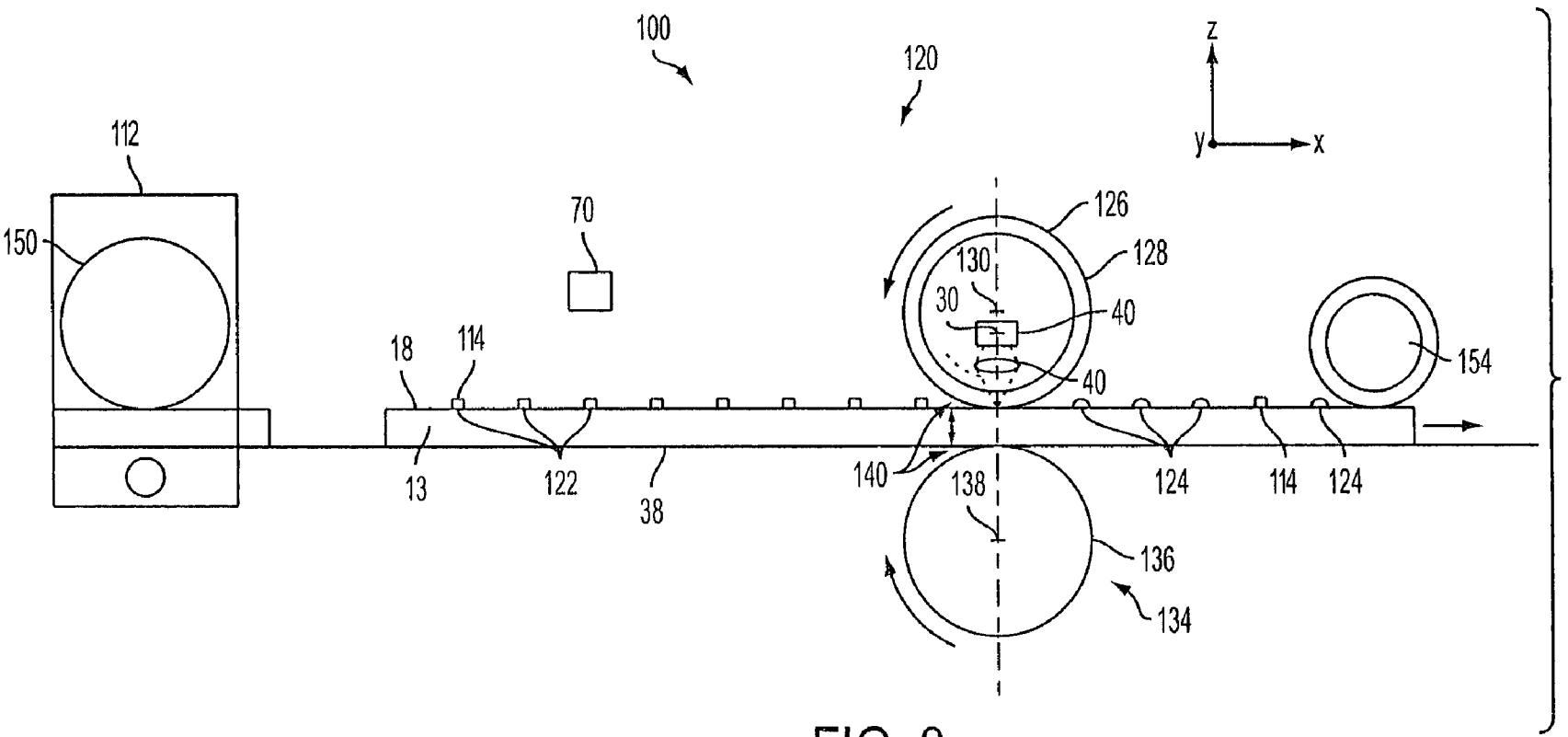
FIG. 3 is a schematic side view of a xerographic marking system incorporating the irradiation device of FIG. 2.

FIG. 3 shows an exemplary xerographic printing system 100, which may be similarly configured to system 10, except as otherwise noted. The system 100 includes a xerographic marking device 112 and an irradiation device 120 which includes an array 30 and lens 40. Array 30 and lens 40 may be similarly configured to those illustrated in FIGS. 1 and 2, and thus will not be described in particular detail herein. The irradiation device 120 also includes a controller comprising a driver for the elements, a processor and an electronic image storage device (not shown), which may be similarly configured to controller 60, driver 50, processor 62 and electronic image storage device 56 of FIG. 2. The irradiation device 120 serves as a fusing device for fusing the marking material, in this case, toner particles. Fusing affects both permanence and appearance (typically gloss) of an image. The fusing may be such as to form a permanent image on the substrate or sufficient to at least tack the image to the substrate. The extent to which an image is fused is generally a function of the amount of energy applied which is a function of the duration and intensity of the applied radiation emitted from the addressable fusing elements to which the marking media is exposed.

The fuser 120 includes a hollow cylindrical fuser member in the form of a roll 126 with an outer surface 128, a longitudinal axis 130 and an interior 132. Fuser 126 also includes an opposing cylindrical pressure roll 134 with an outer surface 136 and a longitudinal axis 138 parallel to and coplanar with axis 130. The axes 130, 138 may be generally aligned in the Y-direction. Fuser roll 126 may be made, for example, of UV-transmitting glass, such as fused quartz or a heat-resistant borosilicate glass (e.g., PYREX™ from Corning, Inc., Corning, N.Y.). Alternatively, the fuser member may in the form of a flexible belt. The belt may be joined at ends thereof to form a continuous loop and held in contact with the pressure roll 134 by suitable pressure applying members, or a disposable belt, as described, for example, in copending application Ser. No. 11/000,168.

Fuser roll 126 and pressure roll 134 are in pressure contact at a point on their respective outer surfaces 128,136, thereby forming a nip 140 therebetween, and are rotatably driven about their respective axes in the directions indicated by the respective arrows, via respective motors or other drive sources (not shown).

The substrate 13, having opposed upper and lower surfaces 18, 38, respectively, is conveyed through the nip. Upper surface 18 includes thereon marking material 114, such as toner, that collectively forms a toner image 122. The marking material comprises a radiation sensitive material, as discussed above. The marking material may arrive at the fuser 120 in an unfused state or in a partially fused state. Toner image 122 may be a black and white (K) image, a process color (P) image, a magnetic ink character recognition (MICR) image, a custom color image (C), combinations thereof, or the like.

The toner image 122 may be formed upstream of fuser 120 using conventional xerographic processes. In general, the marking device 112 includes xerographic subsystems which together comprise an image forming component 150 capable of forming an image on the substrate. The image forming component 150 typically includes a charge retentive surface, such as a photoconductor belt or drum, a charging station for each of the colors to be applied, an image input device which forms a latent image on the photoreceptor, and a toner developing station associated with each charging station for developing the latent image formed on the surface of the photoreceptor by applying a toner to obtain a toner image. A pretransfer charging unit charges the developed latent image. A transferring unit transfers the toner image thus formed to the surface 18 of the substrate.

The array 30 is arranged so that addressable irradiation elements (not shown) are in radiative communication with substrate upper surface 18 when substrate 13 is passing through the nip, or shortly before the substrate passes through the nip. In the illustrated embodiment, a focusing lens 40 is optionally arranged adjacent array 30 to focus radiation at a focal plane coincident with nip 140. While the illustrated array irradiates the nip it is also contemplated that the array may irradiate the substrate upstream of the nip, such that when the toner reaches the nip it has been at least partially melted. In one embodiment, the array 30 may be exterior to the roller 126, for example, located upstream of the nip (i.e., to the left of the roller 126 in FIG. 3).

The toner image 124 exiting the fuser 120 is at least partially fused. In one embodiment, the image is at least tacked to the substrate when it exits fuser 120. A further fusing treatment may be applied subsequent to the fusing treatment applied by fuser 120.

The marking system 100 may further include a cleaning unit 154 downstream of fuser 120. Cleaning unit 154 is adapted to remove unfused toner 114 from substrate upper surface 18 after the substrate has passed through fuser 120. Cleaning unit 154 may include, for example, air jets, air knives, a vacuum, electrostatic transfer elements, brushes or the like (not shown).

In the operation of xerographic system 100, an electronic image of toner image 122 may be captured upstream of the fuser via known techniques associated With the operation of marking device 112 in creating the toner image, as described for the embodiment of FIG. 2.

Substrate 13 proceeds from marking device 112 and is then fed into nip 140 of fuser 120. As substrate 13 proceeds through nip 140, or shortly prior to reaching the nip, the addressable elements 32 in array 30 are selectively activated by driver 50 based on the information in the electronic image so that substantially only those portions of substrate surface 18 that include unfused toner 114 are irradiated. As substrate 13 passes through and exits nip 140, the irradiation, in combination with the applied pressure of fuser roll 126 and pressure roll 134 fixes previously unfused toner 122 to substrate surface 18, thereby forming thereon fixed toner and a corresponding fixed toner image 124. This may be accomplished by only irradiating an area of substrate surface 18 that is minimally larger than that defined by the area covered by unfused toner 114.

In one embodiment, the registration of the image as it reaches the fuser is assumed to be the same as that during the marking process. This assumes that reasonable tolerances can be achieved. Calibration prints may be used as a measure of the registration tolerance. In another embodiment, the toner image is sensed directly prior to the substrate entering nip 140 with a sensor 70. In another embodiment, a local autocorrelation of toner image 22 (or information relating thereto) with printing data is used to determine image properties such as the (X, Y, θ) registration and warpage.

In a more robust embodiment that can measure the dynamic and static registration, the (X, Y, θ) registration of substrate 13 as it enters nip 140 is measured and compared to the registration of toner image 40 as formed on substrate surface 34 during the upstream marking process. This is accomplished, for example, by capturing a second electronic image of the toner image via an image sensor 70, such as a digital camera, arranged upstream of fuser 120 and optically coupled to substrate 13 as it passes under the image sensor.

In various aspects, toner image 22 includes cyan, yellow, magenta, and black images, and addressable elements 32 are activated so that an area on substrate surface 18 that is at most only minimally larger than that defined by the union of these images is irradiated.

After being processed by fuser 120 according to one or more of the exemplary embodiments described above, substrate 13 then passes to cleaning unit 154, which is in operable communication with substrate upper surface 18. Controller 60 directs cleaning unit 154 to remove unfused toner from substrate upper surface 18 (e.g., via blanket clean). By fusing an area of substrate upper surface 18 that is at most only minimally larger than that defined by the unfused toner image 22, any unfused toner remnants (e.g., background streaks, bands and flecks) falling outside of the fused area will be removed from the substrate during cleaning. Without selective fusing, such remnants would be fused to the substrate and not be removable by the cleaning unit.

In an exemplary embodiment, the amount and distribution of UV radiation provided to substrate surface 18 by addressable irradiation elements 32 is varied by driver 50 to accommodate the type and quantity of toner and/or surface finish (e.g. gloss level) desired. Information relating to the type of finish of substrate surface 18 may be input to controller 60 via input device 160. Thus, different surface finishes can be provided to different portions of the substrate or aspects of the type of image to be formed, e.g., a matte finish for pictorials and glossy finish for text, or vice versa. In certain printing applications, variations in the absorptive properties of the toner and the substrate could lead to undesirable variations in printing quality. In such instances, it would be preferred that the transfer of heat to the substrate not depend on the toner and/or the surface characteristics of the substrate.

In another exemplary embodiment, addressable heating elements 32 are used to make the gloss in fused toner image 22 non-uniform, thereby achieving a differential gloss effect. For example, black (e.g., text) portions of an image are irradiated less than color portions such that the black portions may be relatively matt and the color portions may have more gloss.

The printing system 10, 100 may incorporate "tandem engine" printers, "parallel" printers, "cluster printing," "output merger," or "interposer" systems, and the like, as disclosed, for example, in U.S. Pat. Nos. 4,579,446; 4,587,532; 5,489,969 5,568,246; 5,570,172; 5,596,416; 5,995,721; 6,554,276, 6,654,136; 6,607,320, and in copending U.S. application Ser. No. 10/924,459, filed Aug. 23, 2004, for Parallel Printing Architecture Using Image Marking device Modules by Mandel, et al., and application Ser. No. 10/917,768, filed Aug. 13, 2004, for Parallel Printing Architecture Consisting of Containerized Image Marking devices and Media feeder Modules, by Robert Lofthus, the disclosures of all of these references being incorporated herein by reference. In general, a parallel printing system feeds paper from a common paper stream to a plurality of printers, which may be horizontally and/or vertically stacked. Printed media from the various printers is then taken from the printer to a finisher where the sheets associated with a single print job are assembled. Variable vertical level, rather than horizontal, input and output sheet path interface connections may be employed, as disclosed, for example, in U.S. Pat. No. 5,326,093 to Sollitt.

Figure 4:
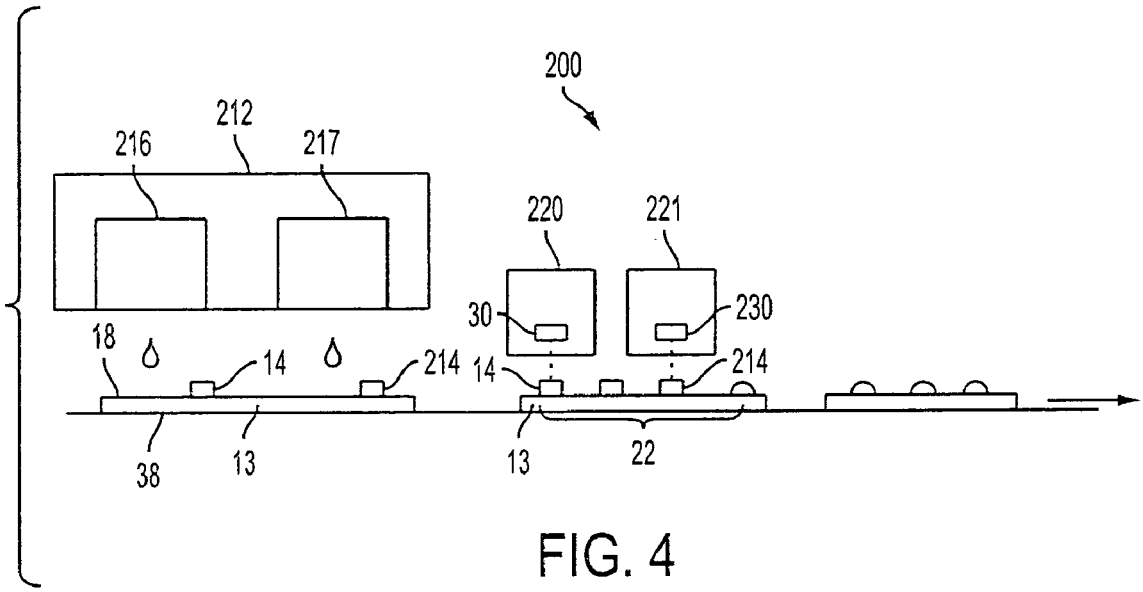
FIG. 4 is a schematic side view of a marking system according to a second aspect of the exemplary embodiment.

FIG. 4 illustrates schematically a marking system 200 in which a plurality of irradiation devices 220, 221 (two in the illustrated embodiment), each configured similarly to device 20 or 120 are arranged in tandem. Each irradiation device includes an array 30, 230, similarly configured and controlled to array 30 of FIGS. 1-3. The array 30 of the first device 220 may irradiate the substrate 13 with radiation of a first wavelength range and array 230 of the second irradiation device 221 may irradiate the same substrate 13 with radiation of a second wavelength. A marking device 212 includes a plurality of image forming components including a first image forming component 216 which deposits a first marking material 14 on the substrate and a second a first image forming component 217 which deposits a second marking material 214 on the substrate. The first marking material 14 includes a photoinitiator which reacts to radiation, such as UV radiation, within the first wavelength range and the second marking material 214 includes a photoinitiator which reacts to radiation, such as UV radiation, within the second wavelength range. In alternative embodiments, a single marking material includes two photoinitiators or a single image forming component deposits marking material 114 and 214.

In operation, the marked substrate is irradiated by the first irradiation device 220 with the driver 50 actuating the addressable elements to irradiate substantially only those portions of an image 22 formed from the first marking material 14 comprising the first initiator. The marked substrate is irradiated by the second irradiation device with the driver 50 actuating the addressable elements to irradiate substantially only those portions of the image 22 formed from the second marking material 214 comprising the second initiator. It will be appreciated that there may be more than two image forming components 216, 217, such as three, four or more, such as one for each color to be applied, e.g., one for each of cyan, magenta, yellow, and black marking material.

In another embodiment, both irradiation devices 220, 221 may irradiate with the same wavelength and both marking materials may comprise the same photoinitiator. In this embodiment, irradiation devices 220, 221 may selectively irradiate different portions of the image by selectively addressing appropriate irradiation elements such that one of the irradiation devices irradiates the portion applied by the first image forming component 216 and the other irradiation device irradiates the portion applied by the second image forming component 217.

Figure 5:
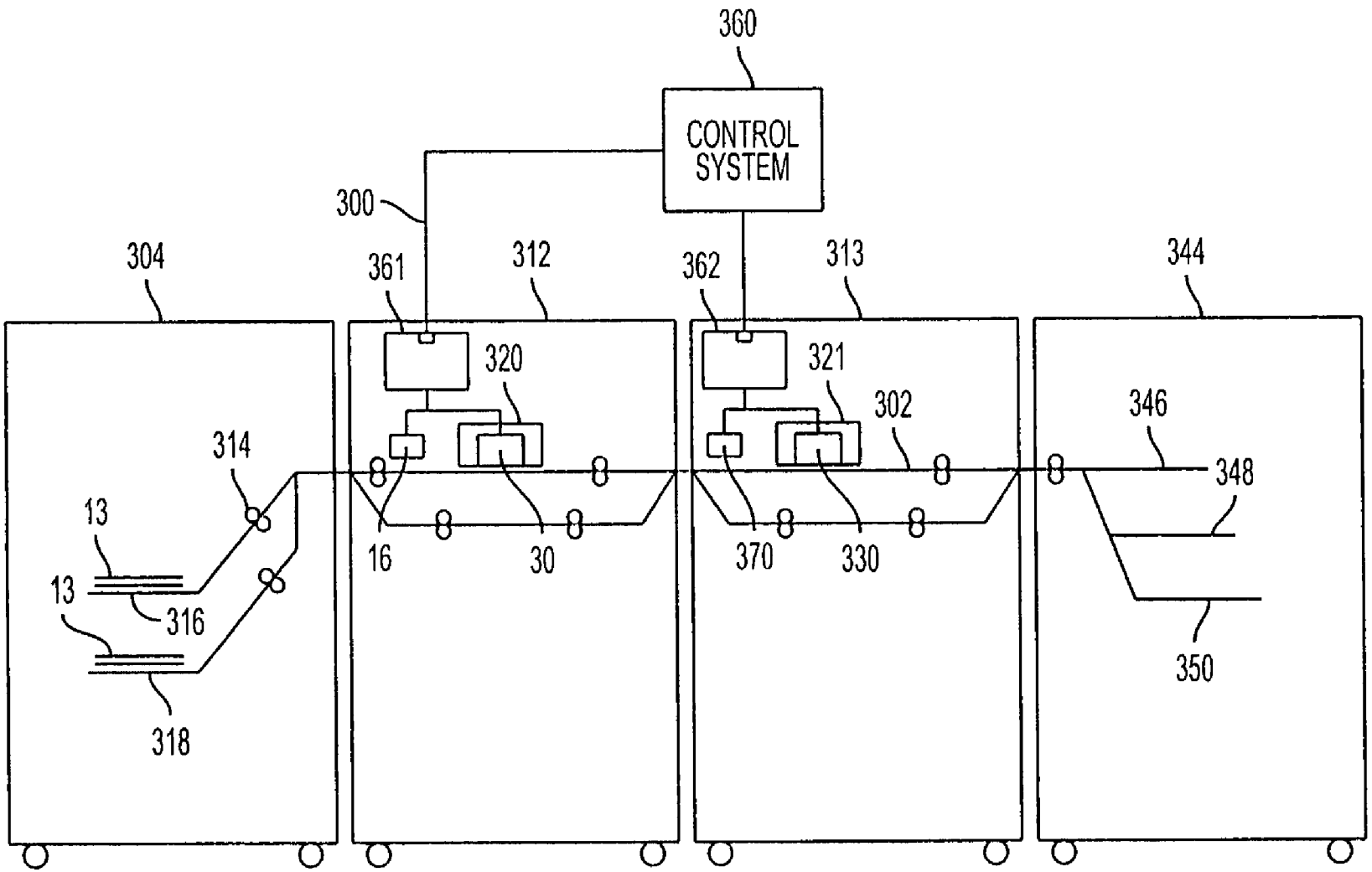
FIG. 5 is a schematic side view of a marking system according to a third aspect of the exemplary embodiment.

FIG. 5 illustrates schematically another exemplary marking system 300, such as a xerographic printing system or ink-jet printing system, in which a conveyor system 302 conveys the substrates 12 from a feeder 304 to a plurality of modular marking devices 312, 313. The conveyor system 302 may include drive elements 314, such as rollers, spherical balls, or airjets, for conveying the substrate through the system 300. The feeder 304 may include a plurality of trays 316, 318 for storing different substrates 13. Each of the marking devices incorporates an irradiation device 320, 321, respectively, such as a fusing device, each of which may be similarly configured to device 20 or 120. Fusing devices 320 and 321 each include an array 30, 330, similar to array 30 of FIGS. 2-4. A common output destination 344, herein exemplified as including a plurality of trays 346, 348, 350, receives substrates from the marking devices 312 and 313, which have been irradiated by one or more of the irradiation devices 320 and 321. The conveyor system 302 is configured such that substrates can be conveyed to any one of the plurality of marking devices 312, 313 for marking, then to the respective irradiation device 320, 321 for irradiation. The illustrated conveyor system 302 is configured such that one or more of the marking devices can be bypassed. It also enables a single substrate to be marked by two or more marking devices 312, 313, and irradiated by two or more of the irradiation devices 320, 321.

As will be appreciated, in the system 300 of FIG. 5, there may be any number of marking devices 312, 313, such as one, two, four, six or more marking devices and that the marking devices may be of the same or different print modalities, such as one or more of black, process color, custom color, and the like. It is also contemplated that the conveyor system 302 may include a more complex system of pathways by which marked substrates can be conveyed between any two or more marking devices. The conveyor system may include inverters, reverters, switches and the like, as known in the art.

The printing system 300 includes a control system 360 which is in communication with a marking device controller 361, 362, associated with each marking device 312, 313. Marking device controllers 361, 362 may be similarly configured to controller 60 shown in FIG. 2. The control system 360 may be responsible for planning and scheduling a print job in which portions of the print job are distributed to the first and second marking devices 312, 313 for printing the respective portions of the print job. The control system may control the marking devices, via the respective marking device controllers 361, 362, to mark and irradiate the substrates so as to meet requirements of the print job.

The marking devices 312, 313 each comprise an image applying component 16, 370, respectively, which serves to apply the marking material, such as ink or toner, to the substrate of the substrate 13 and which may be similarly configured to image applying component 16 of FIGS. 1-4. The marking materials applied by the marking devices 312, 313 can be the same or different and the irradiation devices 320, 321 can irradiate with radiation in the same wavelength range or in different wavelength ranges. In one embodiment, the addressable elements of irradiation device 320 are selectively controlled via controller 361 to irradiate substantially only the area of the image applied in the first marking device 312 and the addressable elements of irradiation device 321 are selectively controlled via controller 362 to irradiate substantially only the area of the image applied in the second marking device 313. Thus, in an exemplary embodiment, UV light is only applied in quantity and location as needed. This minimizes the total radiation generation by modulation of the intensity of the UV sources. The radiation cured pages from one marking device 312 can be more readily handled by the conveyor system 302 and by a subsequent marking device 313.

In conventional systems, a sheet which is imaged and fused two or more times tends to have a higher gloss than a sheet which is fused only once, resulting in differences in image appearance between the pages of a finished document. In the present system, where both marking engines 312, 313 apply an image to the same sheet, the gloss of the twice fused sheet can be more closely matched to that of a once-fused sheet by substantially only irradiating the portions imaged in each marking device.

Figure 6:
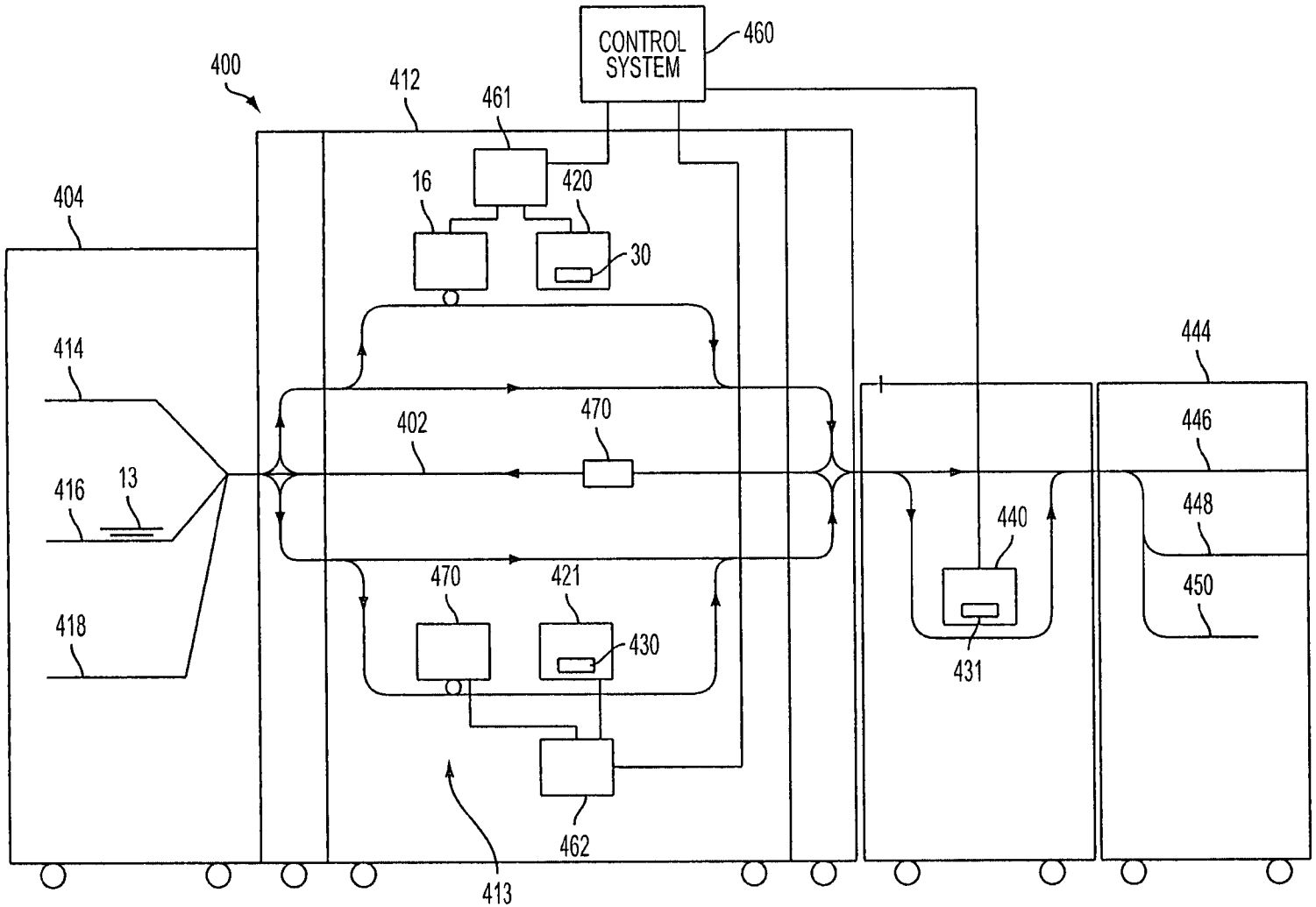
FIG. 6 is a schematic side view of a marking system according to a fourth aspect of the exemplary embodiment.

FIG. 6 illustrates schematically another marking system 400, such as a xerographic printing system or ink-jet printing system in which a conveyor system 402 conveys the substrates 18 from a feeder 404 to a plurality of marking devices 412, 413. The feeder 404 may include a plurality of trays 414, 416, 418 for storing different substrates. Each of the marking devices is associated with a primary fusing device 420, 421, respectively, each of which may be similarly configured to fusing device 20 or 120, or configured as for a conventional fuser (e.g., using heat to fuse at least a portion of an image formed on the substrate by the respective marking device). The conveyor system 402 conveys the marked substrates from the primary fusing devices 420, 421 to at least one common secondary fusing device 440. The common secondary fusing device 440 can be similarly configured to fusing devices 420 or 120, or be a conventional fusing device. At least one of fusing devices 320, 421 and 440 includes an array similar to array 30 of FIGS. 2-3. In the illustrated embodiment each irradiation device includes an array 30, 430, 431, respectively which may be configured as for array 30 of FIGS. 1 and 2. A common output destination 444, such as a stacker, herein exemplified as including a plurality of trays 446, 448, 450, receives substrates from the marking devices 412 and 413, which have been irradiated by one or more of the irradiation devices 420, 421, 440. The conveyor system 402 is configured such that substrates can be conveyed to any one of the plurality of marking devices 412, 413 for marking, then to the primary respective irradiation device 420, 421 for irradiation and to the secondary irradiation device 440 for a second irradiation treatment. The illustrated conveyor system 402 is configured such that one or more of the marking devices can be bypassed. It also enables a single substrate to be marked by two or more marking devices 412, 413, and irradiated by two or more of the primary irradiation devices 420, 421 and allows the secondary irradiation device to be bypassed if desired. The system 400 may be similarly configured to the printing systems described and illustrated in copending applications 60/631,921 and 60/631,921, filed Nov. 30, 2004, incorporated herein by reference. In this case, at least one of the arrays 30, 430, 431 can irradiate with radiation in the UV range of the electromagnetic spectrum.

As will be appreciated, in the system 400 of FIG. 6, there may be any number of marking devices 412, 413, such as one two, four, six or more marking devices and that the marking devices may be of the same or different print modalities, such as black, process color, custom color, and the like.

In the case of a xerographic system, the primary irradiation devices 412, 413 perform at least a partial fusing of the image applied by the image forming component 16, 470. By partial fusing, it is meant that the fixing of the image is not up to the desired level for the final printed media and/or the appearance of the image, e.g., gloss level, is not within desired tolerances, over at least a portion of the image. For example, the primary fusing device serves to at least tack the toner image to the print media (i.e., a partial fixing) in such a way as to allow the print media and toner image to be transported to the secondary fusing device 440, which completes the fusing of the image, for example by modification of the gloss and/or further fixing. In this embodiment, both primary and secondary fusing devices contribute to the fusing of the image on at least a portion of the substrate sheets. The primary fusing device may thus serve to provide what will be referred to as "in situ permanence," while the secondary fusing device is used to generate a desired level of archival permanence and final image appearance. In this embodiment, both primary and secondary fusing devices contribute to the fixation of the image and/or the image quality of at least a portion of the sheets, and/or portions of individual sheets.

To minimize the demands on the integral fusing devices 420, in one embodiment, only enough heat (in the case of a fusing device incorporating heat) or other fusing parameter, such as pressure, light, or other electromagnetic radiation, is used to provide in situ permanence. The gloss level of the imaged media arriving at the secondary fusing device 440 can thus be lower than that desired for its final appearance. Additionally, the level of fixing can be lower than that desired for archival permanence. As a result, reliability and lifetime of the individual marking device is improved. Additionally, higher throughputs can be achieved by reducing the constraints the integral fusing devices 420 place on the marking devices 412, 413. In a conventional printing system, the throughput of the fusing device often limits the throughput of the respective marking device and thus of the overall printing system. Providing a secondary fuser or fusers 440 which take on some of the fusing functions allows higher throughputs for each of the marking devices and thus a higher total productivity to be achieved. Additionally, or alternatively, the secondary fuser can be employed to reduce image inconsistencies in the outputs of the first and second marking devices, e.g., reducing gloss variations between images applied by the first marking device and images applied by the second marking device.

The secondary fusing device 440 may be called upon only in cases where there is a fusing shortfall (fixing, image gloss, image gloss uniformity, productivity) of the primary fusing devices. In this embodiment, the secondary fusing device 440 does not treat all the printed substrates. For example, the primary fusing devices may have sufficient fusing capability such that full fusing of the images on a particular type of paper, at a selected gloss level and desired level of fixing, and at a given productivity, is achieved without operation of the secondary fusing device. Thus, at some times during printing, the primary fusing devices 420, 421 may have the ability to complete the fusing of the printed images (in terms of both fixing and desired appearance characteristics), without the need for the secondary fusing device 440. In such cases, the secondary fusing device 440 is optionally bypassed and the printed media is directed from the respective marking device (s) directly to the finisher 444. At other times, for example, in order to maintain full productivity and/or when the substrate to be used or gloss level desired is such that the primary fusing device cannot maintain complete fusing, the primary fusing device of one or more of the marking devices effects a partial fusing, e.g., it at least serves to tack the toner image to the substrate in such a fashion as to avoid image disturbance as the sheet is transported by the conveyor system 402 to the secondary fusing device 440, where the fusing process is completed. The secondary fusing device 440 can be designed such that it has fusing latitude to accomplish the specified final image fixing and appearance of the media.

In another embodiment, all of the printed media is directed through the secondary fusing device 440. In this embodiment, the secondary fusing device may apply a fusing treatment to all the media, to only to selected substrate sheets, and/or to selected portions of sheets.

The secondary fusing device 440 allows a high gloss mode to be specified. In this mode, a gloss level higher than that which can be achieved by an individual marking device at the desired productivity for the particular print media selected is achieved.

The printing system 400 includes a control system 460 which is in communication with a marking device controller 461, 462, associated with each marking device. Marking device controllers 461, 462 may be similarly configured to controller 60 shown in FIG. 2. The control system 460 may be responsible for planning and scheduling a print job in which portions of the print job are distributed to the first and second marking devices for printing the respective portions of the print job. The control system may control the marking devices, via the respective marking device controllers 461, 462, to mark and irradiate the substrates and may also control the secondary fusing device 440 to provide a secondary fusing treatment, so as to meet requirements of the print job.

For example, the control system 460 addresses the secondary fusing device to correct unwanted variations in gloss both across the sheet and between sheets from different marking devices. The control system 460 may determine the appropriate level of secondary fusing to apply to the substrate to achieve preselected final fusing characteristics (appearance and/or level of fixing).

In one embodiment, the secondary fusing or curing device 440 is used to apply the equivalent of a watermark to the substrate by providing an area of the substrate imaged surface, which has a modified property, e.g., an altered marking material property that is either visible or machine readable, such as a higher gloss level, a color shift, the modified UV reflectance, or a change in electrical conductivity. The area may be of a preselected shape, e.g., the shape of a company logo, or may carry encoded information for the purpose of authentication or job integrity control. For example, an area of different gloss is distinguishable to the eye when the substrate is tilted at a sufficient angle. Information on the shape and location of the gloss watermark may be stored in the control system algorithm. Where the gloss watermark comprises an area of higher gloss than the surrounding area, the control system addresses the secondary fusing device to selectively apply UV radiation to the area of the substrate where the gloss watermark is to be formed. Another example employs a machine to read an invisible authentication code recorded in a portion of an image in the form of a UV written pattern where the UV exposure modifies the UV reflectance of the material.

In other aspects, gloss variations within the image are reduced by selectively irradiating portions of the image with different radiation intensities. For example, some colorants or colorant combinations may yield differences in gloss which can be reduced by selectively irradiating the portion of the image at a higher or lower intensity than other portions.

A sensor 470, such as a gloss meter, detects a property of the marked substrates, such as gloss. The sensor may be located anywhere in the conveyor system 402 which is accessible to substrates marked by the first and second marking devices 412, 413. In the illustrated embodiment, the sensor 470 is located upstream of the secondary fusing device 440. In another embodiment, the sensor 470 is located downstream of the secondary fusing device 440, such as between the secondary fusing device and the finisher 444. In yet another embodiment, the sensor is an offline sensor. The sensor 470 may periodically evaluate substrates, e.g., test sheets, marked and irradiated by the first and second marking devices 412, 413, and may communicate the measurements made to the control system 360, which stores information from the sensor in an algorithm. Measurements on gloss and/or other fusing characteristics can thus be used by the control system to determine appropriate settings for the secondary fusing device 440 and or provide instructions to the marking device controllers 461, 462, so as to make adjustments to the operation of the irradiation systems 420, 420.

The exemplary marking systems 10, 100, 200, 300, and 400 may receive image data from a computer network, scanner, digital camera, or other image generating device (not shown).

Figure 7:
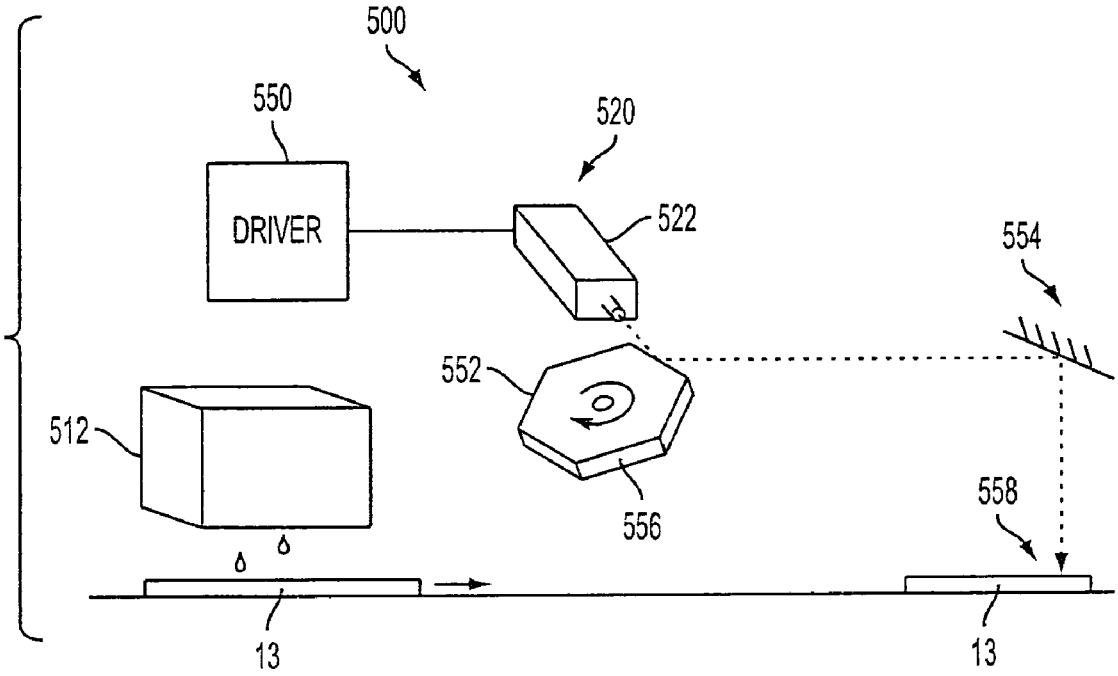
FIG. 7 is a perspective view of a marking system in accordance with a fifth aspect of the exemplary embodiment.

With reference to FIG. 7, another embodiment of a marking system 500 is shown. The marking system includes an image applying component 512 which can be analogously configured to image applying component 12 or 112. An irradiation system 520 receives marked substrate from the image applying component 512. The irradiation system 520 includes a source 522 of UV radiation which is selectively addressed by a driver 550. The source 522 can be a high energy laser source. A faceted rotating UV reflective mirror 552 is positioned to direct the UV radiation form the source toward the marked substrate, either directly or indirectly, via an intermediate optical system, such as a mirror 554. The mirror 552 can have from about four to about twelve facets 556 and be in the shape of a regular polygon. The driver 550 causes the source 522 to be actuated at various times, the times being predetermined, for every image, to cause a spot 558 to irradiate those portions of the substrate which have been marked and to leave unmarked portions substantially non-irradiated. The spot 558 moves in the Y direction and thus serves as an array of selectively addressable elements. The speed at which the spot traverses the substrate in the Y direction can be many times faster than the speed at which the substrate moves in the X direction. For example, the mirror 552 can rotate at a speed of from about 10 to about 20,000 rpm or higher, each revolution corresponding to a number of traversals equivalent to the number of facets. The optimal rotation speed will depend on the time taken for the source 520 to be actuated and then deactivated. In one embodiment, the time for actuation and deactivation is only a fraction of the traversal time, e.g., less than one tenth of the traversal time. The source 522 can write at different UV energy levels and generally has a spot size somewhat larger than the pixel size of the associated image applying component (not shown). In the case of an image applying component 512 which utilizes solid marking media (toner particles), the mirror 544 (and optionally the mirror 552 and source 522) can be located within a fuser roll (not shown) which is UV transmissive, in a manner similar to that shown in FIG. 3. Alternatively, the mirror 554 can be positioned so as to direct the UV radiation onto the substrate 13 upstream of the fuser roll to melt the toner shortly before entering the nip.

Figure 8:
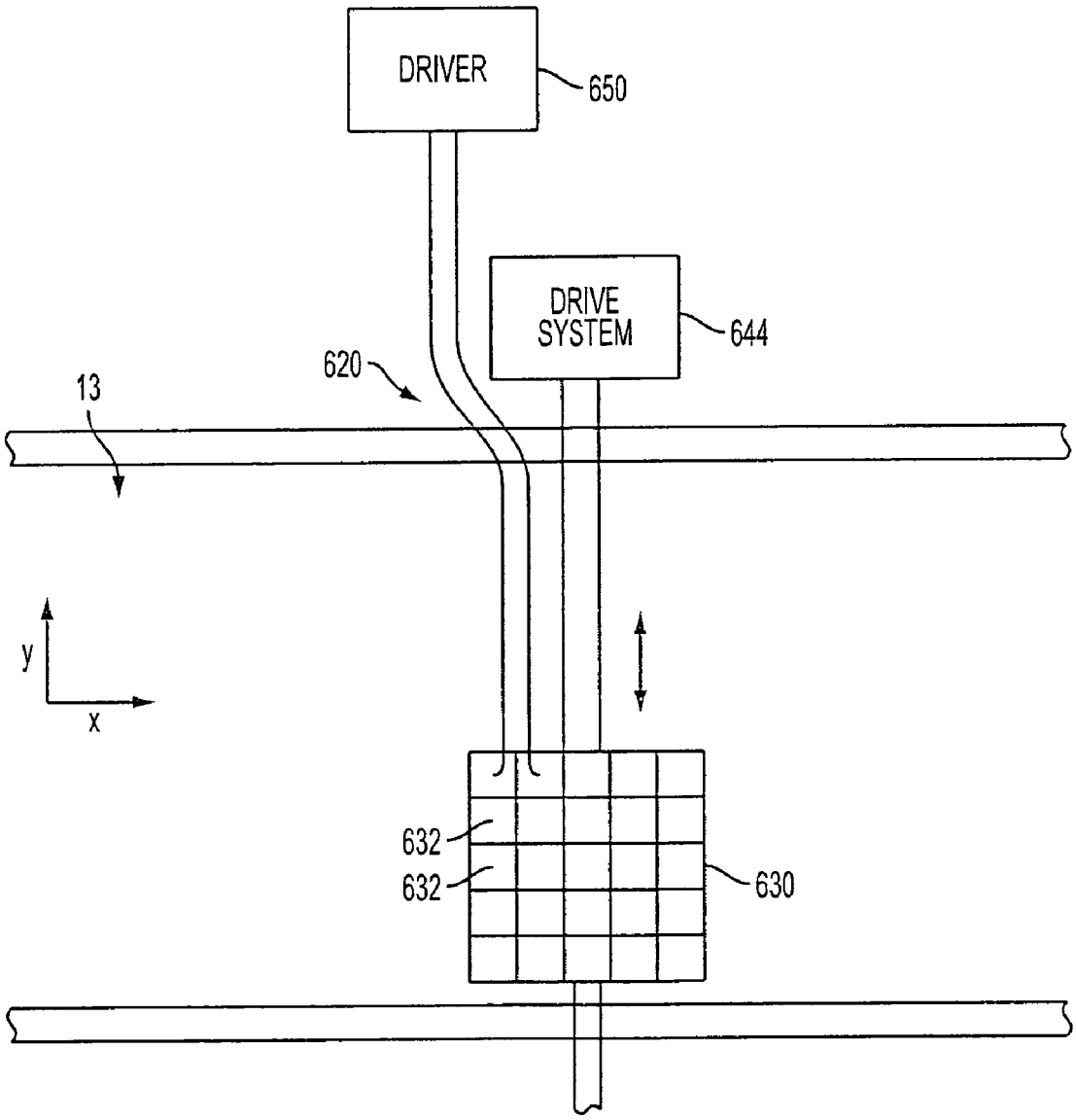
FIG. 8 is a perspective view of an irradiation device in accordance with a sixth aspect of the exemplary embodiment.

With reference to FIG. 8, another embodiment of an irradiation system 620 is shown. The irradiation system 620 can be incorporated in a marking system 10, 100, 200, 300, or 400 with any of the image applying components illustrated and described herein. The irradiation system 620 includes an array 630 of addressable irradiation elements 632 similarly configured to elements 32 which may which is smaller in the Y direction than the width of the substrate. The array is translated parallel to the Y axis, by a drive system 644 as the substrate 13 passes beneath the array. A driver 650, similarly configured to driver 50, selectively addresses the elements 632. As with other embodiments, each of the elements may be actuable at a single UV irradiation energy or have two or more selectable UV irradiation energy levels. The Y direction translation can be at least a plurality of times faster than the speed of the substrate, e.g., at least 10 times faster so that a single sheet is traversed many times by the addressable array 630. Additionally, the elements 632 can be addressed when the array is moving in a first Y direction and in a second, reverse Y direction. It will be appreciated that a single element 632 may be actuated and deactivated a plurality of times as the substrate 13 is traversed by the array in one direction. Due to the movement of the substrate between successive actuations, the subsequent actuations irradiate the sheet in the X direction at a location upstream of an earlier actuation.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A marking system comprising:

a first image applying component for applying a marking material to a substrate in forming an image on the substrate, the marking material comprising a radiation sensitive material;

a first addressable irradiation device which receives the marked substrate from the first image applying component, the irradiation device providing an array of addressable irradiation elements for irradiating the marked substrate, at least some of the irradiation elements being selectively actuable, the irradiation device emitting radiation within a range of wavelengths to which the radiation sensitive material is sensitive;

a second image applying component for applying a marking material to a substrate in forming an image on the substrate, the marking material comprising a radiation sensitive material;

a second addressable irradiation device which receives the marked substrate from the second image applying component, the irradiation device providing an array of addressable irradiation elements for irradiating the marked substrate, at least some of the irradiation elements being selectively actuable, the irradiation device emitting radiation within a range of wavelengths to which the radiation sensitive material is sensitive;

a secondary irradiation device which receives marked and irradiated substrates from the first and second irradiation devices; and a control system in communication with the secondary irradiation device, the control system determining an appropriate secondary irradiation treatment to reduce a variation in appearance between substrates irradiated by the first irradiation device and substrates irradiated by the second irradiation device.

2. The marking system of claim 1, wherein the addressable irradiation elements generate radiation in the ultraviolet region of the spectrum and wherein the radiation sensitive material reacts in the presence of ultraviolet radiation.

3. The marking system of claim 1, further comprising a controller operably coupled with the first irradiation device, the controller comprising at least one driver which selectively actuates the addressable irradiation elements.

4. The marking system of claim 3, wherein the controller receives information on the location of the image on the substrate and addresses elements so as to irradiate an area of the substrate which is substantially no larger than that covered by the image by selective activation of the array of addressable irradiation elements as the substrate moves relative to the array.

5. The marking system of claim 1, wherein each of the addressable irradiation elements has a plurality of selectable radiation intensities.

6. The marking system of claim 1, wherein marking system comprises a xerographic marking system and wherein the marking material comprises a toner.

7. The marking system of claim 6, wherein the first irradiation device comprises a fuser which includes first and second rollers which define a nip therebetween, the nip receiving the substrate therethrough.

8. The marking system of claim 7, wherein the array of addressable irradiation elements is disposed within the first roller and wherein the first roller is transmissible to the radiation.

9. The marking system of claim 1, wherein marking system comprises an inkjet marking system and wherein the marking material comprises an ink.

10. The marking system of claim 1, further comprising a conveyor which conveys the substrate between the image applying component and the array.

11. The marking system of claim 1, wherein the array comprises a plurality of columns of elements, which extend generally perpendicular to the direction of travel of the substrate, each column comprising a plurality of addressable elements.

12. The marking system of claim 11, wherein the array includes at least three columns of addressable elements.

13. The marking system of claim 1, wherein the array includes at least forty independently addressable elements.

14. The marking system of claim 1, wherein each of the selectively actuable elements comprises an individual source of radiation.

15. The marking system of claim 1, wherein the selectively actuable elements of the array are provided by a selectively addressed radiation spot which is moved in a direction generally perpendicular to the direction of travel of the substrate.

16. A marking system comprising:

at least one image applying component for applying a marking material to a substrate in forming an image on the substrate, the marking material comprising a radiation sensitive material;

an addressable first irradiation device which receives the marked substrate from the image applying component, the irradiation device comprising an array of addressable irradiation elements for irradiating the marked substrate, the irradiation device emitting radiation within a range of wavelengths to which the radiation sensitive material is sensitive; the array comprising a plurality of rows of elements, which extend generally parallel with the direction of travel of the substrate, each row comprising a plurality of independently addressable elements;

a secondary irradiation device which receives marked and irradiated substrates from the irradiation device; and a control system in communication with the secondary irradiation device, the control system determining an appropriate secondary irradiation treatment to reduce a variation in appearance between substrates irradiated by the first irradiation device and substrates irradiated by a second irradiation device.

17. The marking system of claim 16, comprising a first image applying component associated with the first irradiation device and a second image applying component associated with the second irradiation device.

18. The marking system of claim 16, wherein the array includes at least ten rows of addressable elements.

19. A marking method comprising:

applying a marking material to a first substrate to form an image on the substrate, the marking material comprising a radiation sensitive material;

irradiating the marked first substrate with a first array of addressable irradiation elements, at least a plurality of the irradiation elements emitting radiation in a range of wavelengths within which the radiation sensitive material reacts, the plurality of irradiation elements being selectively actuated;

applying a marking material to a second substrate to form an image on the substrate, the marking material comprising a radiation sensitive material;

irradiating the marked second substrate with a second array of addressable irradiation elements, at least a plurality of the irradiation elements emitting radiation in a range of wavelengths within which the radiation sensitive material reacts, the plurality of irradiation elements being selectively actuable; and irradiating at least one of the marked first and second substrates with a third array of addressable irradiation elements, at least a plurality of the irradiation elements emitting radiation in a range of wavelengths within which the radiation sensitive material reacts, the plurality of irradiation elements being selectively actuable to reduce a variation in appearance between the first and second substrates.

20. The method of claim 19, wherein the irradiation includes irradiating an area of the substrate which is substantially no larger than that covered by the image by selective activation of the array of addressable irradiation elements as the substrate moves relative to the array.

21. The method of claim 19, wherein the irradiation includes irradiating some portions of the image with a greater intensity of irradiation than other portions of the image.

22. The method of claim 21, wherein information is added to the image by selectively irradiating a portion of the image with radiation of a greater intensity.

23. The method of claim 21, wherein gloss variations within the image are reduced by selectively irradiating portions of the image with different radiation intensities.

* * * * *